United States Patent [19]

Miller

[11] Patent Number: 4,878,606

[45] Date of Patent: Nov. 7, 1989

[54] HARNESS FOR SHOULDER SUPPORTED BAG

[75] Inventor: Murray G. W. Miller, Thunder Bay, Canada

[73] Assignee: Murlyn Enterprises Ltd., Orillia, Canada

[21] Appl. No.: 552,944

[22] Filed: Nov. 17, 1983

Related U.S. Application Data

[63] Continuation-in-part of Ser. No. 258,816, Apr. 29, 1981.

[30] Foreign Application Priority Data

Jan. 9, 1981 [CA] Canada ..... 368,202

[51] Int. Cl.[4] ..... A45F 3/14

[52] U.S. Cl. ..... 224/208

[58] Field of Search ..... 224/208, 264, 253, 911

[56] References Cited

U.S. PATENT DOCUMENTS

| | | | |
|---|---|---|---|
| 2,037,132 | 4/1936 | Hoyt | 224/911 X |
| 3,883,053 | 5/1975 | Pritchard et al. | 224/264 |
| 3,910,470 | 10/1975 | Swenson et al. | 224/208 |

FOREIGN PATENT DOCUMENTS

| | | | |
|---|---|---|---|
| 237107 | 3/1945 | Switzerland | 224/208 |

*Primary Examiner*—Henry J. Recla
*Attorney, Agent, or Firm*—Bruce E. Morgan

[57] ABSTRACT

The present invention relates to a waist bag and supporting harness comprising a pelvic belt, a diagonal shoulder strap, shoulder pad means, and underarm strap suitable for attaching to a conventional mail bag or similar bag. The harness restrains movement of the bag while in use, and inhibits posture deformation of the user. The harness of the present invention partially redistributes the load of such a bag or device, by providing a pelvic belt to take most of the weight of the bag, and reducing the weight supported by the shoulder strap. As well, the pelvic belt enhances the stability of a user's center of gravity by retaining the bag in a substantially constant position relative to the user's body while performing mobile duties.

A shoulder pad and strap are restrained by an underarm strap to reduce stress in the neck muscles by preventing the pad and a strap from rising up on to the sensitive and vulnerable areas of the lower neck. The bag is provided with a plurality of horizontal belt receiving loops to selectively retain the pelvic belt and position the bag properly relative to the body height of the individual user.

8 Claims, 2 Drawing Sheets

HARNESS FOR SHOULDER SUPPORTED BAG

CROSS REFERENCE TO RELATED APPLICATION

This application is a continuation-in-part of applicant's prior U.S. application Ser. No. 258,816, filed Apr. 29, 1981, for Restraining Harness For Shoulder Supported Bag, now abandoned.

The present invention relates to a waist bag and supporting harness intended to reduce the detrimental effects of carrying an eccentric load. Waist bags, such as conventional mail-carrier's bags, newspaper delivery bags and cone-picking bags have a shoulder strap traversing diagonally across the users' body from one shoulder to the bag carried at waist level on the opposite hip of the user. The weight of such a bag imposes an unbalanced load upon the user, as the bag is carried to one side only. Generally, the effort required to carry such an unbalanced load increases the further the bag is located from the user's body. An unrestrained bag can swing like a pendulum away from user's body, thereby imposing increasingly unbalanced stresses on the carrier's neck and spine. When a normal healthy lumbar spine is subjected to traumatic postural and occupational stress, such as induced by the eccentric load of a mail-carrier's waist bag, asymmetrical muscle function develops if this state is allowed to maintain itself over a period of time. Further, the mechanics of the spine become altered, which over an extended period of time result in mechanical aberrations which ultimately cause tissue damage and permanent disability.

Commonly among mail carriers and persons utilizing similar bags, the two chief areas of physical complaint and injury are the shoulders and back. This is due to the asymmetry of the load bearing and its effects upon the spine and shoulders. The spine is forced to adopt a compensatory postural alignment which involves unbalanced use of back muscles and asymmetrical stress on some spinal and pelvic joints and on the hips. This asymmetry is constantly amplified while a user is walking, thereby generating exaggerated stresses on the pain sensitive tissues of the spine, pelvis and hips. My investigations have disclosed 70% of all letter carriers investigated suffer from lower back pain, displaying signs and symptoms of mechanical low back disorder, primarily involving the sacro-iliac mechanism.

Additionally, the shoulder strap of conventional bags such as mail bags tends to ride up on a user's lower neck, as a result of the location of the eccentric load carried on the opposite side of the body. Consequently, there exists direct compression by the shoulder strap on the shoulder and lower neck (trapezius) muscles of the user. These muscles respond with excess contraction in order to dissipate such compression. A chronic state of stress to the shoulder muscles eventually results in dysfunction and symptomatology. My investigations have disclosed that 77% of letter carriers experience pain in the neck and mid-spine region.

The discomfort, pain and temporary or permanent injury resulting from use of such conventional bags is serious and costly in terms of the time-off of injured workers. It has been noted that postal workers are injured twice as much as any other work force with consequent increased costs resulting from the lost man-hours.

Use of the harness of the present invention reduces or eliminates sprains and strain incurred by letter carriers and workers performing similar tasks. The present invention provides a waist bag and supporting harness adapted to be worn by a user, comprising an adjustable shoulder strap and adjustable pelvic belt cooperating with the bag, and an adjustable underarm strap. The bag is supported by the pelvic belt by means of a multiple belt loop system integral with the face of the bag adjacent the user's hip. The harness restrains movement of the bag while in use and inhibits postural deformation of the user by partially redistributing the load so that the pelvic belt carries most of the weight of the bag, rather than the weight being transmitted to the shoulder strap. As well, the pelvic belt enhances the stability of the user's centre of gravity by retaining the bag in substantially constant position relative to the user's body while performing mobile duties. Furthermore, the shoulder strap and shoulder pad may be restrained by an underarm strap which prevents the pad and strap from riding up on the sensitive and vulnerable areas of the lower neck.

The bag and harness system disclosed herein reduces bio-mechanical stress, improves the user's stability, produces an increase of comfort during use and decreases the incidence of shoulder and back complaints. Postural distortion and stress are significantly reduced when compared with the use of conventional bags. The shoulder pad and underarm strap combine to reduce compression strain and enhance the stability of the bag on the shoulder, thereby reducing the need for unconscious muscle effort. The pelvic belt produces a more balanced position, reduces walking stresses on the low back, and reduces the muscular effort needed by the pelvic and hip muscles while walking.

In the drawings which illustrate embodiments of the invention:

Figure 3:
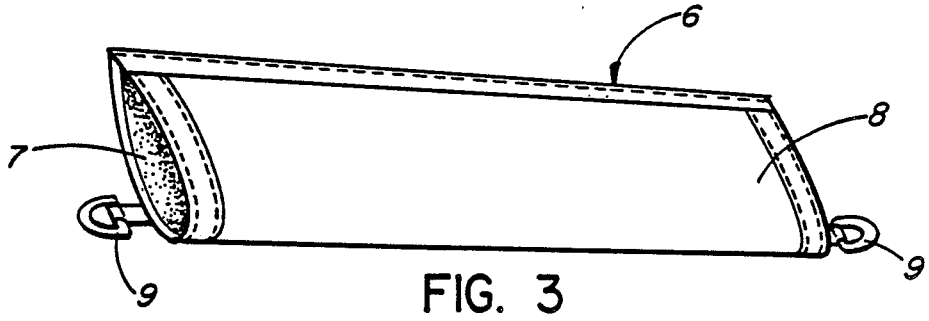
FIG. 3 is a perspective view of one embodiment of the shoulder padding means of the invention.
Figure 4:
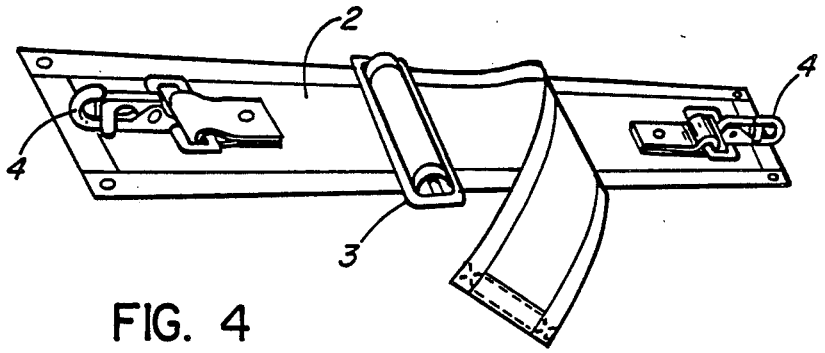
FIG. 4 is a perspective view of a shoulder strap of the invention.

The harness of the invention is used with a bag 1 generally located at the waist or hip level of a user, which bag is supported by a diagonal shoulder strap 2. In mail bags commonly used, as may be seen in FIG. 4 the shoulder strap is adjustable in length through a slip buckle 3, and has snap hooks 4 at each end thereof which fasten to D-rings 5 on the bag 1. The harness of the invention is attached to such a bag and shoulder strap and comprises a shoulder pad 6 which is attached at the shoulder portion of strap 2 so as to be interposed between the underside of strap 2 and a user's shoulder. As may best be seen in FIG. 3, pad 6 may be a flattened tube or sheath having inner surface 7 and outer surface 8. Desirably the pad is made of heavy weather-resistant canvas with an interior resilient pading such as foam rubber, also of a weather-resistant nature. In such an embodiment, the shoulder strap 2 would be inserted through the pad 6 until the pad is located at approximately mid-longitudinal point of the shoulder strap. Clearly, many other forms of shoulder pads are possible which may be attached to the shoulder strap, for instance, by snaps, tying or Velcro® fasteners. The shoulder pad 6 has a D-ring 9 attached at each longitudinal end.

Figure 5:
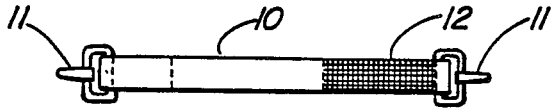
FIG. 5 is a planned view of the shoulder restraint means or underarm strap of the invention.

An underarm strap 10 may be passed under the user's arm and attached to the D-rings 9 of the shoulder pad 6 by means of spring clips 11 located at each end of the strap 10, as may be seen in FIG. 5. Strap 10 is adjustable in length, which adjustment may be accomplished by means of a buckle type fastener associated with one of the spring clips. Alternatively strap 10 may be a composite strap formed of two individual portions adjustably held in face to face contact by opposed Velcro® fasteners 12 or similar type of fastener.

The underarm strap 10 restrains the shoulder pad 6 from riding up on to the neck, and prevents excessive pressure on the pain-sensitive nerves and muscles of the lower neck.

Figure 1:
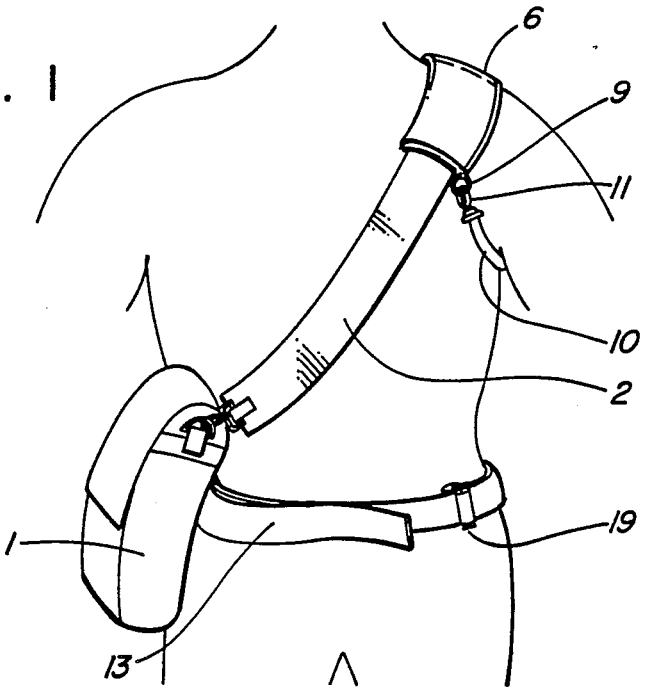
FIG. 1 is a frontal elevation of the bag and harness.
Figure 2:
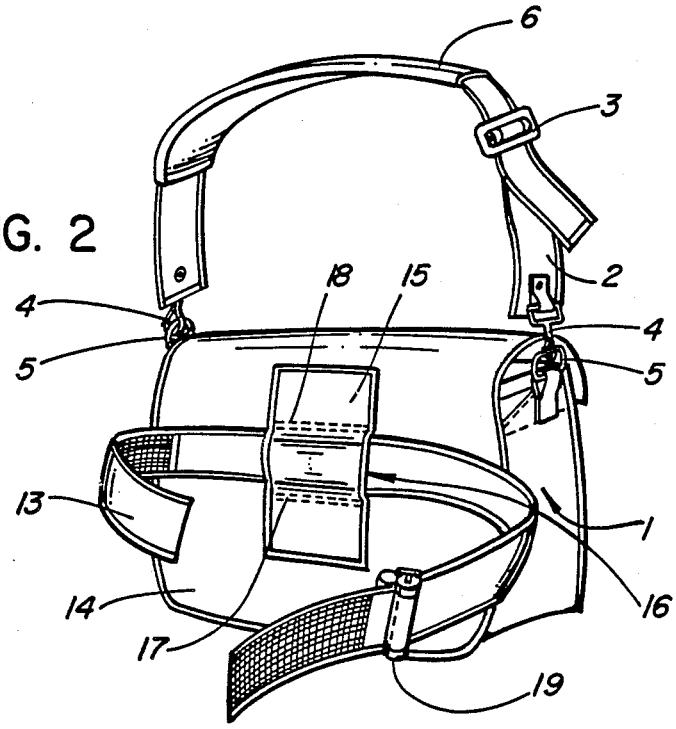
FIG. 2 is a rear elevation of the bag and harness.
Figure 6:
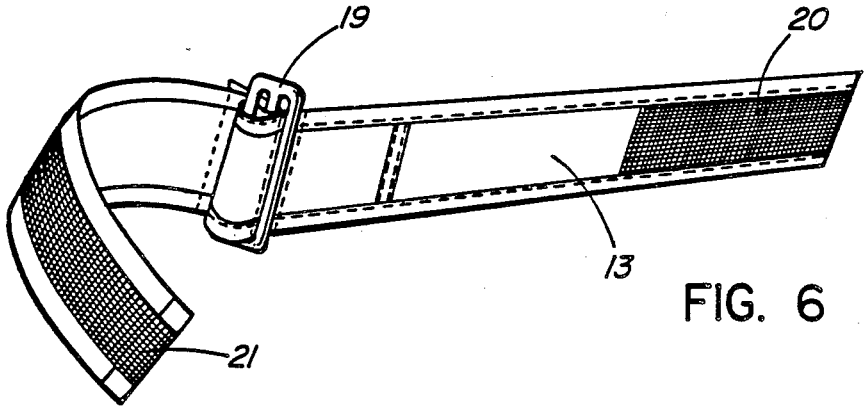
FIG. 6 is a perspective view of the pelvic belt means of the invention.

As may be seen from FIGS. 2 and 6, pelvic belt 13 fastens to the face 14 of bag 1 by means of a multiple belt loop system. A vertical web 15 of material is attached at its upper and lower extremities to face 14 of the bag. Additional intermediate points of attachment are made between the web 15 and the face 14 whereby several horizontal passages or loops are affected, as represented by passage 16 defined by the inner face of web 15, the face 14 of the bag, and intermediate horizontal rows of stitching 17 and 18. FIG. 2 illustrates a multiple belt loop system having three horizontal passages and illustrates pelvic belt 13 passed through selected passage 16.

In order to ensure a snug fit of pelvic belt 13 around the body of the user, and thereby to restrain movement of the waist bag, belt 13 is provided with a slide buckle 19 to permit adjustment for various waist sizes. The belt 13 may then be fastened by a standard buckle connection, or as may be seen in FIG. 6, a further adjustable fastening may be provided whereby opposed Velcro® fastener sections 20 and 21 are provided at the terminal sections of the belt whereby face to face contact of the Velcro® fasteners permits fastening of the belt.

The provision of the adjustable multiple belt loop attachment means of web 15 and belt 13 permits the bag to be worn at a height selected by the user to provide greatest comfort and restraint while the pelvic belt 13 is still securely fastened about the user's hips. By this aspect of the invention the utility and advantages of the bag and harness are available to typical users without significant height limitations.

The design of the multiple belt loop attachment means is of considerable advantage in practice when compared with existing bags held by D-rings at opposing ends of the bag. D-rings and similar means at the opposing ends of the bag produce a drawstring effect, and actually tend to keep the bag closed. On the other hand, the multiple belt loop system assists the user in reaching the contents of the bag because the bag tends to open naturally as a result of the central attachment location. This is an important factor for users who may open such a bag up to 300 times per day.

In a preferred embodiment of the invention, I have utilized a web 15 of approximately 6 inches in width, and located the web centrally on the bag face 14 approximately 5½ inches from each end.

As may be seen in FIG. 2, in use, the bag and harness is worn with the shoulder strap 2 and underarm strap 10 on either the left or right shoulder, depending upon the preference of the carrier, with the shoulder pad 6 interposed between the shoulder strap 2 and the shoulder of the user. The shoulder restraining strap 10 passes under the associated arm of the carrier and is snugly attached by spring clips 11 to the D-rings 9 of the shoulder pad 6. The shoulder strap 2 diagonally traverses the chest and the back of the user to attach to the bag by means of snap hooks 4 and D-rings 5. The pelvic belt 13 is attached to the face 14 of bag 1 by the multiple belt loop system of web 15. It is then tightened snugly by means of slide-buckle 19 and Velcro® fasteners 20 and 21.

It is essential for the low pelvic belt to be worn snugly so that the large muscles of the pelvis and legs assume more responsibility for the work load. The bone structure of the legs and pelvis is larger and more conducive to support of a heavy weight than the delicate structure of the neck and shoulder. The pelvic belt, in addition to preventing sideways motion of the bag, substantially supports the load of the bag and thereby redistributes load from the shoulder and neck muscles to the large muscles of the pelvis and legs.

Although the use of the harness has been illustrated with reference to a bag such as a mail-carrier's bag, it will be appreciated that other types of bags imposing an unbalanced load on the user can be adapted for the attachment of the harness. Also, minor changes in the fastening means can be made without departing from the invention. Bags may also be made which include the harness as original equipment.

I claim:

1. A waist bag and supporting harness adapted to be worn by a user, comprising an adjustable shoulder strap and pelvic belt cooperating with the bag wherein the waist bag has one face which is oriented towards the waist of the user, which said one face has an associated pelvic belt retention means comprising a plurality of loops arranged in a vertical column, each of which is adapted to receive a horizontally pelvic belt, wherein the pelvic belt may be positioned through a selected one of said loops to support and restrain movement of the bag.

2. The bag and harness of claim 1 wherein the shoulder strap includes shoulder pad means.

3. The bag and harness of claim 2 wherein the shoulder pad means is adapted to be removably attached to the shoulder strap.

4. The bag and harness of claims 1, 2 or 3 wherein an underarm strap cooperates with the shoulder strap to restrain movement of the shoulder strap on to the lower neck of the user.

5. The belt and harness of claims 1, 2 or 3 wherein an underarm strap is connected by one end to the shoulder pad means on one side of a user's body and extends under the proximate arm of the user to connect by the other end with the shoulder pad means on the other side of the user's body.

6. The belt and harness of claims 1, 2 or 3 wherein each of said loops provides a generally horizontally extending aperture adapted to receive said pelvic belt.

7. The bag and harness of claims 1, 2 or 3 wherein the vertical column of loops is located within the medial half of the bag.

8. The bag and harness of claims 1, 2 or 3 wherein the vertical column of loops comprises a vertical strap generally centrally attached to the bag at a plurality of points intermediate top and bottom connections whereby a plurality of horizontal slots are defined between the face of the bag and the strap.

* * * * *